US007104332B2

(12) United States Patent
Murray et al.

(10) Patent No.: US 7,104,332 B2
(45) Date of Patent: Sep. 12, 2006

(54) METHOD AND APPARATUS FOR CREATING A CEMENTED LATERAL JUNCTION SYSTEM

(75) Inventors: Douglas J. Murray, Humble, TX (US); Aubrey C. Mills, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 89 days.

(21) Appl. No.: 10/697,373

(22) Filed: Oct. 30, 2003

(65) Prior Publication Data

US 2004/0092404 A1 May 13, 2004

Related U.S. Application Data

(60) Provisional application No. 60/425,355, filed on Nov. 11, 2002.

(51) Int. Cl.
*E21B 7/04* (2006.01)

(52) U.S. Cl. ..... 166/380; 166/50; 166/117.5

(58) Field of Classification Search ..... 166/380, 166/384, 313, 50, 117.5
See application file for complete search history.

(56) References Cited

U.S. PATENT DOCUMENTS

| | | | | |
|---|---|---|---|---|
| 5,462,120 | A * | 10/1995 | Gondouin | 166/380 |
| 5,477,925 | A | 12/1995 | Trahan et al. | 166/382 |
| 5,484,017 | A | 1/1996 | Coon | 166/117.5 |
| 5,615,740 | A | 4/1997 | Comeau et al. | 166/380 |
| 6,041,855 | A | 3/2000 | Nistor | 166/50 |
| 2002/0023757 | A1 | 2/2002 | George et al. | 166/380 |

* cited by examiner

*Primary Examiner*—William Neuder
(74) *Attorney, Agent, or Firm*—Cantor Colburn LLP

(57) ABSTRACT

An apparatus for creating a cemented lateral junction including a sleeve with a premachined opening and a cover disposed at the sleeve. A release material is disposed at the cover.

Further disclosed is a method for constructing a wellbore which includes preparing a sleeve with a premachined window and a cover positioned to occlude the window and a release material at at least a portion of the cover exposed to environment through the window for running in the wellbore. The method may further include installing the sleeve in a wellbore and applying a hardenable agent to an annulus of the wellbore around the sleeve.

29 Claims, 4 Drawing Sheets

METHOD AND APPARATUS FOR CREATING A CEMENTED LATERAL JUNCTION SYSTEM

CROSS REFERENCE TO RELATED APPLICATIONS

This application claims the benefit of an earlier filing date from U.S. Provisional Application Ser. No. 60/425,355 filed Nov. 11, 2002, the entire disclosure of which is incorporated herein by reference.

BACKGROUND

Hydrocarbon exploration drilling and production schemes have in more recent years made regular use of multilateral wellbores. By definition such wellbores include intersections between lateral boreholes and primary boreholes. These intersections are called junctions. Junctions are rated with respect to their specific attributes from level 1 to level 6 in the Technical Advancement of Multilaterals (TAML) characterization system with level 1 being the lowest level of complexity and function and level 6 being the highest level of complexity and function. There are many tools and/or systems available to create a lateral junction system, one of which is a product offered commercially by Baker Oil Tools, Houston, Tex. and known to the industry as a hook hanger liner system. The system is known to be very effective in creating level 3 multilateral junctions according to the Technical Advancement of Multilaterals (TAML) characterization system. These systems are very popular and effective for their intended purpose but cannot be relied upon to provide a cemented junction that would be required for a TAML 4 rating. While the hook hanger liner system is sometimes cemented and can result in a cemented junction that is not the current expectation. Currently the cementing and cleaning process is intended to cement an annulus around the lateral liner but not to cement up the junction because as a practical matter the cleaning process will wash cement out of the junction area.

Since cemented junctions are often desirable and the hook hanger liner system is a popular and effective multilateral tool, it would be well received by the industry to have a hook hanger liner system capable of achieving a cemented level 4 junction in those wells that require one.

SUMMARY

Disclosed herein is an apparatus for creating a cemented lateral junction system which includes a sleeve with a premachined opening therein and a cover disposed at the sleeve. A release material is disposed at the cover.

Further disclosed herein is a method for constructing a wellbore which includes installing a lateral diverter in a lateral junction system and applying a release material to the lateral diverter. The method further includes running foregoing elements in a borehole and deploying the lateral junction system in a lateral exit window. Applying a hardenable agent to the lateral junction system is also performed. Further, a method for constructing a wellbore which includes preparing a sleeve with a premachined window and a cover positioned to occlude the window and a release material at at least a portion of the cover exposed to environment through the window for running in the wellbore. The method further includes installing the sleeve in a wellbore and applying a hardenable agent to an annulus of the wellbore around the sleeve.

BRIEF DESCRIPTION OF THE DRAWINGS

Referring now to the drawings wherein like elements are numbered alike in the several Figures.

DETAILED DESCRIPTION

Taught herein by way of example is a method and apparatus to cause a component placed downhole and cemented to be removable from the placed position after setting of the cement. The component may be of a large number of types and includes tubulars (i.e., removability of an entire joint), tubular with windows covered (discussed hereunder), etc. This requires that the adhesive properties of the cement be defeated with respect to the component that is intended to be removable. For this purpose a release agent is applied to the component such that cement cannot stick thereto. The release agent is a physical barrier between the cement and the component. Release agents may be of a number of types providing the bond of the release agent to the component is insufficient to prevent defeat thereof by pulling in a normal well operation using normal equipment.

Figure 1:
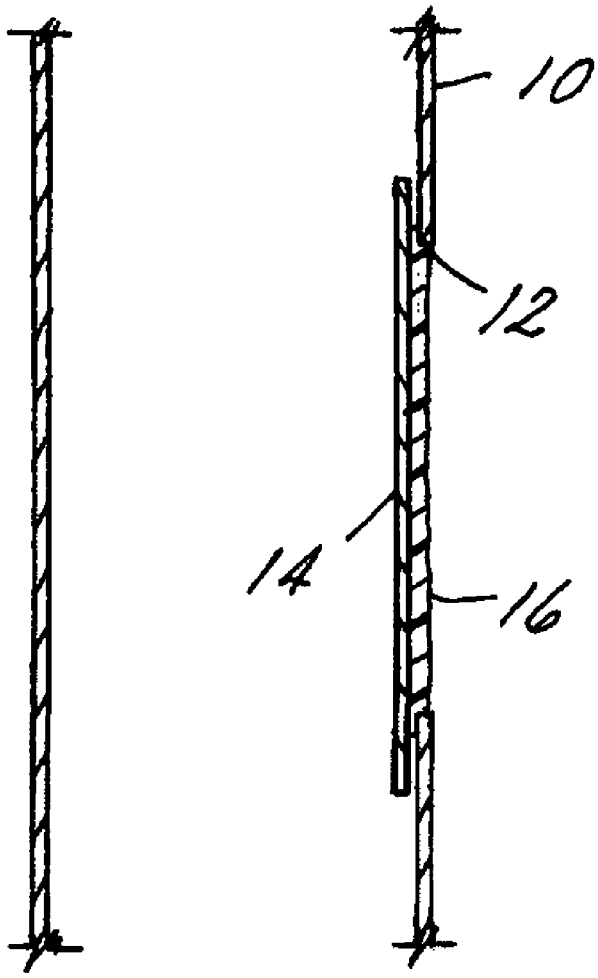
FIG. 1 is a cross-sectional schematic view of a premachined window joint with a cover therein.

The method and apparatus disclosed herein maybe embodied (see FIG. 1) in a tubular member 10 having a premachined window 12 therein and a cover 14 for the opening. The cover is to have a portion which will prevent ingress of cement through the window and which portion is at least partly coated with a release agent 16 to prevent or reduce adherence of cement thereto. In such condition, the cover 14, which may be a sleeve, can be easily removed after a cementing operation. With the cover removed, drilling out the cement from beyond the premachined window is a simple matter. It is of course notable that no metal need be drilled away as the cover, if metal, was removed prior to or contemporaneously with the drilling operation.

One embodiment of the foregoing concept is the formation of a cemented junction. The concept facilitates fully cementing a junction, allowing the cement to set and then having the ability to remove the cover in order to drill for access back to the main bore. Clearly the concept, both method and apparatus can be utilized to form any kind of junction needing merely location, orientation and depth, it is convenient to describe the concept by example with reference to a Hook Hanger Liner System commercially available from Baker Oil Tools, Houston, Tex.

As the hook hanger liner system will be familiar to those of skill in the art, it is used as one example of the type of apparatus and method disclosed herein. The description of its components and the method of using the same is abbreviated herein. The description herein is focused upon the distinctions relevant to the disclosure hereof and the relative position of components making up such distinctions over a prior art hook hanger liner system. For purposes of this discussion it is assumed that at least a primary or main borehole and a lateral root extending therefrom are in existence. It is also noted that the term primary or main are intended to be relative terms only and denote the bore from which a lateral bore exits. In fact, such primary or main bore may actually itself be a lateral bore from another primary bore, and so on. One of ordinary skill in the art will appreciate how such structure can be generated. Such is not germane to this disclosure.

Figure 2:
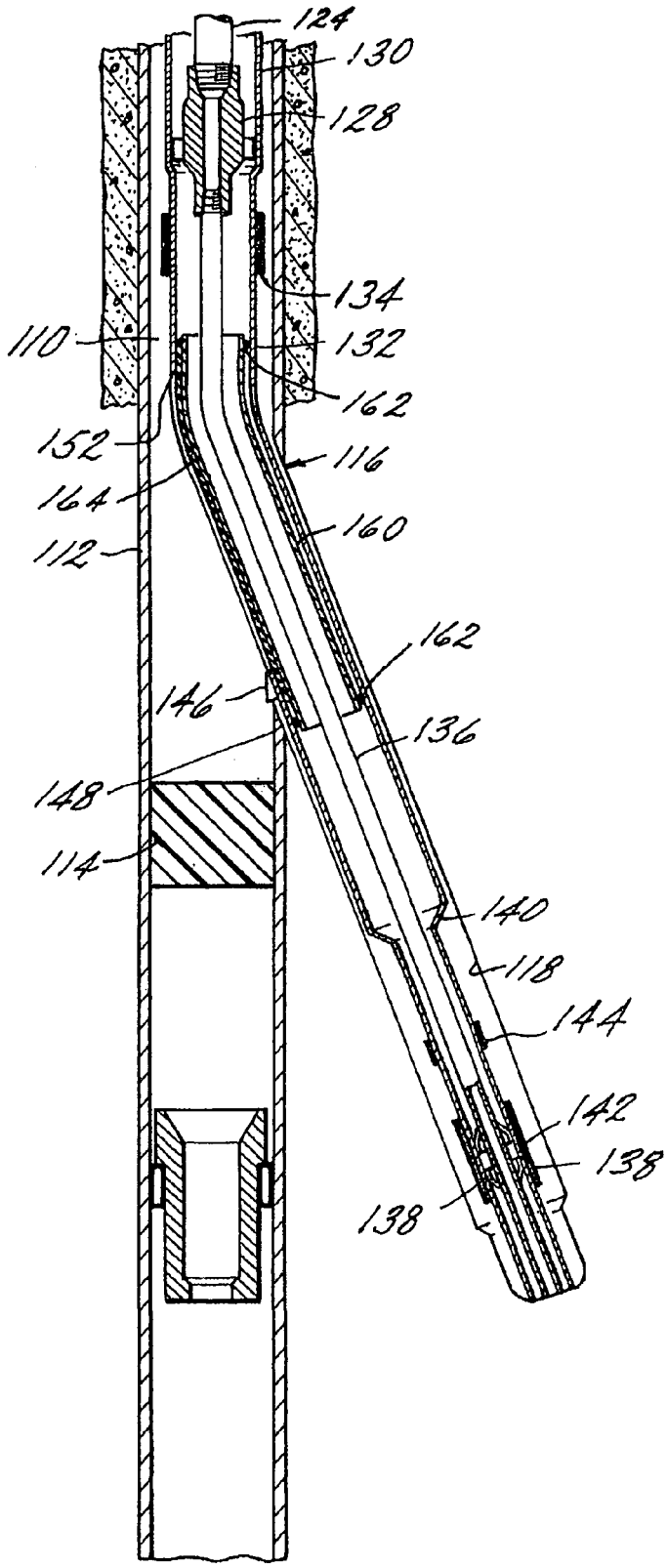
FIG. 2 is a cross-sectional elevation view of a lateral junction system in a borehole.

Referring to FIG. 2, a summary of components and relative locations is given for a hook hanger liner system. Primary or main borehole 110 is illustrated with casing 112, window 116 and lateral borehole 118 extending therefrom. The following equipment is installed on the end of a section of drill string 124. First, a liner running tool 128 together with a liner setting sleeve with tieback extension 130 and liner sleeve 132 is mounted to drill pipe 124. Attached to the liner sleeve 132 near the liner running tool 128 is an external casing packer 134. An optional external casing packer 134 remains in the main borehole 110.

Attached to the liner running tool 128 inside the liner sleeve 132 is a tail pipe 136 which has movable opposing swab cups 138 attached to tail pipe 136. A cross-over 140, which allows the rest of liner sleeve 132 to be a smaller diameter, is located about ⅔ of the length along liner sleeve 132. Also, near the end of the tailpipe 136 there is an external casing packer 142 which can be used to cement the annular space between liner sleeve 132 and lateral borehole 118. A cementing valve 144 is located on liner sleeve 132 just above external casing packer 142.

Below external casing packer 134 is a premilled window 152 in liner sleeve 132 which allows for re-entry into the primary borehole 110 after completion of the junction between lateral borehole 118 and primary borehole 110. A "hook" 146 is displayed on liner sleeve 132, the "hook" has primary functions (among others) including:

(1) acting as a stop to preclude the liner sleeve 132 from exiting the window 116; and (2) hanging the weight of liner sleeve 132 and any induced or other associated loads.

On an inside diameter of liner sleeve 132 is positioned a lateral diverter 160 to temporarily block access through window 152 to main bore 110. Lateral diverter also provides additional stiffness to liner sleeve 132. In one embodiment, lateral diverter 160 further includes seals 162 at uphole and downhole ends thereof such as o-rings. In embodiments using seals 162, liner sleeve 132 may also include polished seal bores, on an inside diameter of liner sleeve 132 where seals 162 contact the inside diameter of liner sleeve 132. Lateral diverter 160 is mounted in the position shown in FIG. 1 prior to running the tool in the hole and is treated with a material 164 on the outside diameter thereof. As noted above, the purpose of material 164 (release agent) is to prevent the adhesion of later applied cement to the portion (or at least a portion) of lateral diverter 160 that would but for the material be exposed through window 152. One appropriate material is silicone rubber, another is polyurethane, yet another is latex paint, but it will be appreciated that any material facilitative of removal of the diverter 160 after setting and/or curing of the cement is acceptable. Effectively, this means that a material that creates not more than a weak bond with diverter 160 or with the cement (it is not significant which interface releases, diverter-to-material, or material-to-cement as the same result will be achieved), weak being defined merely as allowing the diverter to be separated therefrom and pulled uphole without special procedures not normally associated with pulling diverters from wellbores would be an acceptable material. It should be stated that in some applications a "weak" bond at the release material-to-cement interface may be preferred in some situations since in that instance more of the release material would be carried out of the well still adhered to the diverter or cover. This would reduce ancillary contamination of the well. Materials that have higher bonding properties may still be employed providing an additional release agent is interposed between said higher bonding material and said diverter 160 to effect the desired release characteristics. Diverter 160 and its material together prevent the entrance of cement during a cementing operation from entering the inside diameter of liner sleeve 132.

It should be noted that other properties of the release agent or material may be relevat to particular operations. For example, it may, in some applications be desirable for the material to be resilient whereas in others, resiliency of the material may not be needed. It is anticipated by the inventors hereof that resilient material will more often be preferred since when the cover, diverter, etc. is removed and some if not all of the material is released into the well fluid, resilient material is less likely to cause ancillary damage. Too, the thickness of the applied material should be taken into consideration. While only a thin layer of material is necessary to prevent cement bonding, thin material is shed form the interface after separation, in thin sheets thick application of material is shed in thicker chunks. Depending upon what well equipment is to be encountered, thin sheets or thick chunks may be more desirable. In addition, other factors such as degree of resiliency desired may affect the selection of material thickness, a thicker application of material will be more resilient. Finally it should be appreciated that other hardenable agents beyond cement may be employed in a process similar to those described herein. In such event the chemical makeup of the material/release agent should be considered for compatibility in order to achieve the desired end which as stated is releasability of a diverter, cover, sleeve, etc. from a set hardenable agent.

Figure 3:
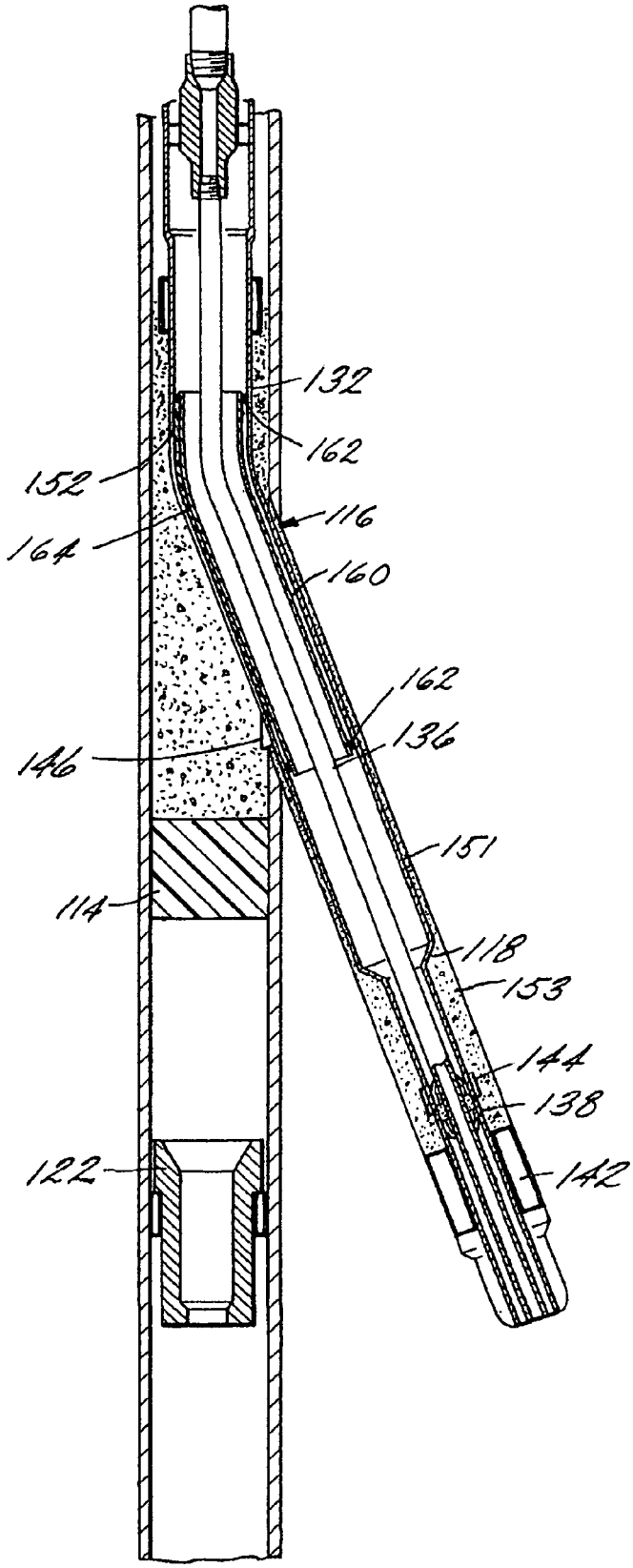
FIG. 3 is a view of the embodiment of FIG. 2 with a cementing process just finished.
Figure 4:
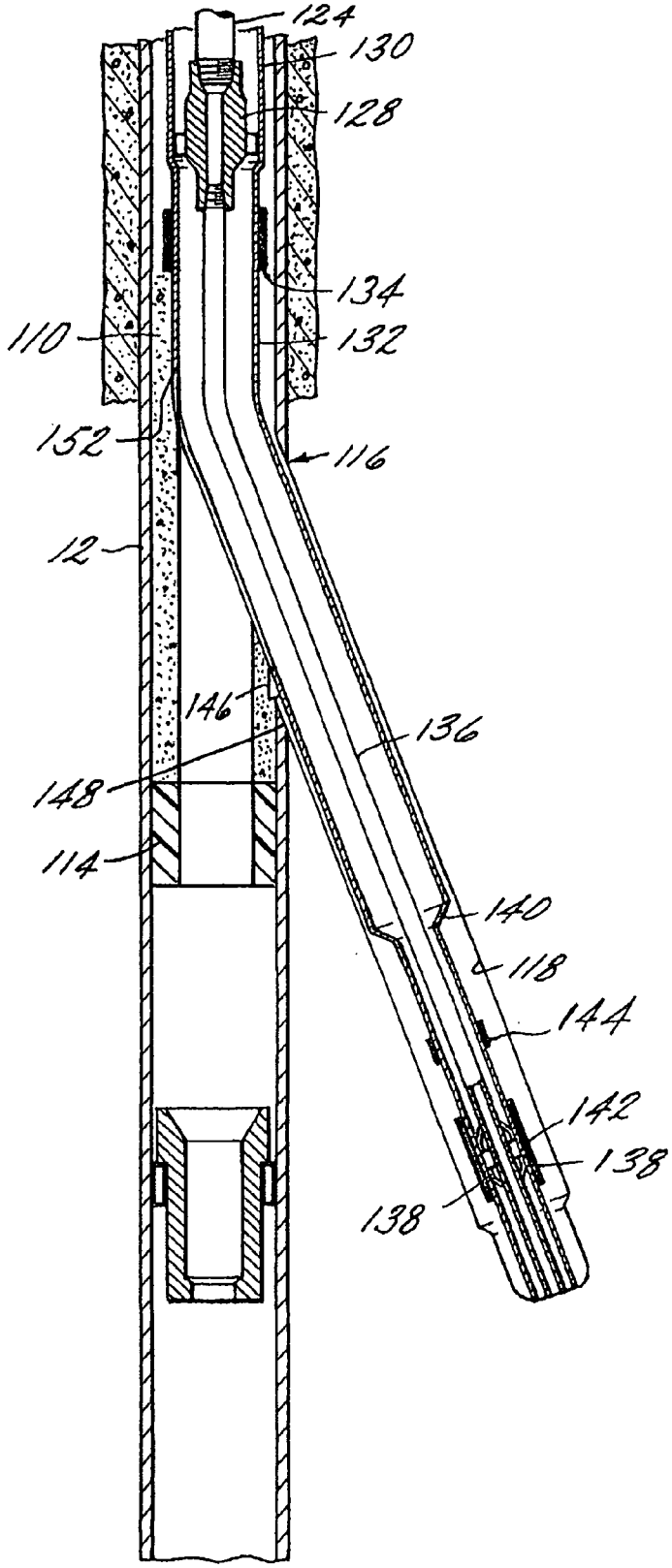
FIG. 4 is a view of the embodiment of FIG. 2 with the main bore reopened.

Referring back to FIGS. 2–4 in the event a cement column extending above the location of diverter 160 in a wellbore is large, thus creating high pressure on the material 164, it is possible where the material is a softer elastomer like silicone, for such material to be extruded into the inside diameter of liner sleeve 132 along with some of the surrounding cement. Clearly this is undesirable as it is the consequence which the teaching hereof is intended to prevent.

In such situation, such extrusion can be prevented by the employment of seals 162 as discussed and shown. Seals 162 create a hydraulic seal which effectively prevents extrusion of the material 164 into liner sleeve 132. Where a high pressure is not anticipated, the seals 162 are not needed for this function although may be employed for another function.

The hook hanger liner system described above is run into the primary borehole 110. The "hook" liner system self orients the liner sleeve 132 after sleeve 132 traverses window 116.

Following correct orientation, lateral exit and setting operations with respect to the hook hanger liner system, a cementing operation is performed (see FIG. 2). Cement is caused to flow out of a downhole location of liner sleeve 132 or a liner extending therefrom (not shown). Cement 153 is flowed through cementing valve 144 and into annulus 151. When the cement 153 has been delivered to the target area in an amount calculated to ensure that it has extended a desired distance back into the main bore 110, pumping of cement 153 will be terminated.

When cement 153 reaches window 116 it begins to move through window 116 into main bore 110. Temporary plug 114 prevents migration of the cement to downhole areas of the main bore 110 where it is not intended to go. Temporary plug 114 may be created in a number of ways such as building a sand bridge, heavy gel pills, bridge plugs, etc. Any of these may be placed as schematically illustrated at 114 in FIGS. 1 and 2. Which plug is selected depends upon a number of factors including but not limited to pressure, hole angle, etc. One of ordinary skill in the art is aware of how to make the determination.

Returning to the cementing operation, since the cement cannot migrate past plug 114 it is forced to migrate in the uphole direction and thus to surround the junction and continue up main bore 110 for a selected distance, generally to the vicinity of the top of the liner sleeve 132. Cement that spills over the top of liner sleeve 132 can be cleaned up with conventional cleaning operations.

During the cleaning operations lateral diverter 160 is still in place within sleeve liner 132. This is distinguished from the prior art because without the release capability of material 164, diverter 160 would have to be pulled prior to setting of the cement or it would be adhered thereto. The subsequent cleaning operation would wash out the cement at the junction. Leaving the diverter 160 in place, as noted previously, prevents the entry of cement to the ID of sleeve liner 132 but also prevents the washout of cement around the junction during the cleaning operation.

Once the errant cement is cleaned out, the properly situated cement is allowed to set. Post setting, the diverter 160 may be removed at any time. In some cases it will be left in place for some time during other well activity or indeed even no activity. In other cases it will be immediately removed after cement set to regain access to the main bore 110.

When it is determined the diverter 160 should be pulled from the well it is retrieved by any of a number of retrieval methods which are known to the art. Due to the release material installed prior to running and described above, the bond with the diverter 160 is broken and the diverter may easily be withdrawn. Once the diverter is removed, a main bore diverter may be run in the hole and a milling tool or other appropriate tool depending upon type of temporary plug 114 may be run. The milling tool will mill the cement that is between window 152 and temporary plug 114 (and will mill the plug too if that was intended) and if a plug is to be retrieved, a retrieval tool may be run to effect the same.

Access is available to both lateral and main bore for further creation of laterals or for completion of the wellbore or other operation. Advantageously the junction is completely cemented. In this condition the hook hanger liner system achieves a level 4 TAML rating.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed is:

1. An apparatus for creating a cemented lateral junction system comprising:

a sleeve;

a premachined/opening in said sleeve;

a cover disposed at said opening; and a release material disposed at said cover and exposed to environment exterior to said sleeve said release material facilitating displacement of said cover in one piece.

2. An apparatus for creating a cemented lateral junction system as claimed in claim 1 wherein said release material isolates at least a portion of said cover exposed to environment exterior to said sleeve.

3. An apparatus for creating a cemented lateral junction system as claimed in claim 1 wherein said release material forms a weak bond with said cover.

4. An apparatus for creating a cemented lateral junction system as claimed in claim 3 wherein said material is silicone.

5. An apparatus for creating a cemented lateral junction system as claimed in claim 3 wherein said material is an elastomer.

6. An apparatus for creating a cemented lateral junction system as claimed in claim 3 wherein said material is an air cured resin.

7. An apparatus for creating a cemented lateral junction system as claimed in claim 3 wherein said material is polyurethane.

8. An apparatus for creating a cemented lateral junction system as claimed in claim 1 wherein said release material further creates a seal between said sleeve and said cover.

9. An apparatus for creating a cemented lateral junction system as claimed in claim 1 wherein said cover and said sleeve further define an intersection therebetween having a hydraulic seal.

10. An apparatus for creating a cemented lateral junction system as claimed in claim 9 wherein said hydraulic seal comprises a seal bore on an inside dimension of said sleeve and a seal on an outside dimension of said cover.

11. An apparatus for creating a cemented lateral junction system as claimed in claim 10 wherein said seal is an o-ring.

12. An apparatus for creating a cemented lateral junction system as claimed in claim 1 wherein said cover is a sleeve.

13. An apparatus for creating a cemented lateral junction system as claimed in claim 1 wherein said cover is a lateral diverter.

14. An apparatus for creating a cemented lateral junction system as claimed in claim 1 wherein said sleeve is a liner sleeve.

15. An apparatus for creating a cemented lateral junction system as claimed in claim 1 wherein said release material is on all of said cover exposed to environment exterior to said sleeve.

16. A method for constructing a wellbore comprising:

installing a lateral diverter in a lateral junction system;

applying a release material to said lateral diverter;

running foregoing elements in a borehole;

deploying said lateral junction system in a lateral exit window; and applying a hardenable agent to said lateral junction system.

17. A method for constructing a wellbore as claimed in claim 16 wherein said applying is cementing.

18. A method for constructing a wellbore as claimed in claim 17 wherein said cementing includes cleaning out.

19. A method for constructing a wellbore as claimed in claim 16 wherein said method further comprises allowing said cement to set.

20. A method for constructing a wellbore as claimed in claim 16 wherein said method further includes pulling said diverter.

21. A method for constructing a wellbore as claimed in claim 20 wherein said diverter is pulled after setting of the cement.

22. A method for constructing a wellbore as claimed in claim 20 wherein said pulling includes separating said diverter from said cement by defeating bonding properties of said release material.

23. A method for constructing a wellbore comprising:

preparing a sleeve with a premachined window, a cover positioned to occlude said window and a release material isolating at least a portion of said cover exposed to environment through said window said release material facilitating displacement of said cover in one piece, for running in the wellbore;

installing said sleeve in a wellbore; and applying a hardenable agent to an annulus of said wellbore around said sleeve.

24. A method for constructing a wellbore as claimed in claim 23 wherein said method further comprises removing said cover after applying the hardenable agent.

25. A method for constructing a wellbore as claimed in claim 23 wherein said method further comprises drilling the hardenable agent through said premachined window.

26. A method for constructing a wellbore as claimed in claim 23 wherein said release material covers all of said portion of said cover exposed to environment through said window.

27. A method for constructing a wellbore as claimed in claim 23 wherein the hardenable agent is cement.

28. A method for constructing a wellbore as claimed in claim 23 wherein said installing includes locating and orienting said sleeve.

29. A method for constructing a wellbore as claimed in claim 28 wherein said locating and orienting is accomplished by landing a hook in a hook hanger liner system in a window of said wellbore.

* * * * *